US007438394B2

(12) United States Patent
Hirano

(10) Patent No.: US 7,438,394 B2
(45) Date of Patent: Oct. 21, 2008

(54) INKJET HEAD AND METHOD FOR MAKING THE SAME

(75) Inventor: Tadashi Hirano, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 321 days.

(21) Appl. No.: 11/080,021

(22) Filed: Mar. 14, 2005

(65) Prior Publication Data

US 2005/0206686 A1 Sep. 22, 2005

(30) Foreign Application Priority Data

Mar. 22, 2004 (JP) ..... 2004-083278

(51) Int. Cl.
*B41J 2/045* (2006.01)

(52) U.S. Cl. ..... 347/68; 347/69

(58) Field of Classification Search ..... 310/325, 310/326, 334; 156/292, 330; 347/68–72
See application file for complete search history.

(56) References Cited

U.S. PATENT DOCUMENTS 6,207,730 B1 * 3/2001 Hogan, III ..... 523/219
2004/0051762 A1 * 3/2004 Nishi et al. ..... 347/68

* cited by examiner

*Primary Examiner*—Stephen D Meier
*Assistant Examiner*—Geoffrey Mruk
(74) *Attorney, Agent, or Firm*—Frishauf, Holtz, Goodman & Chick, P.C.

(57) ABSTRACT

An inkjet head includes: an electrostrictive actuator having an ink channel to eject ink; and a manifold member for supplying the ink to the ink channel, wherein the actuator and the manifold member are jointed with an adhesive containing adhesive material and balloon filler.

12 Claims, 2 Drawing Sheets

INKJET HEAD AND METHOD FOR MAKING THE SAME

BACKGROUND OF THE INVENTION

1. Field of the Invention

The present invention relates to an inkjet head and method for making the same. In particular, the present invention relates to an inkjet head including an actuator containing a piezoelectric material for converting electric energy into mechanical energy for ejecting ink and a manifold member constituting an ink channel for supplying ink for the actuator, wherein the actuator and the manifold member are jointed with an adhesive, and a method for making the same.

2. Description of Related Art

As for an inkjet head that ejects ink by using a shear mode of a piezoelectric material, such as PZT, for converting electric energy into mechanical energy for ejecting ink, a great feature is that ink liquid to be ejected has great latitude and nonaqueous inks such as oil inks and solvent inks can be ejected as compared to an inkjet head of the system using generation of air babble owing heating of ink as energy for ejecting.

However several solvent inks have corrodibility of expanding/transforming or solving a resinous member constituting an inkjet, or the like. Selection of an adhesive used for adhesive assembly of an ink channel part of an inkjet head is limited from the viewpoint of resistance to solvent inks.

According to the inventor's study of the resistance of an adhesive to various solvent inks, it is found that those having an enhanced crosslink density of an adhesive have a tendency to have an increased resistance to solvent inks, and simultaneously, it was found that a tendency for the adhesive to be stiff and have a higher Tg (glass transition point). As a result of this, all adhesives usable for solvent inks are those which have less flexibility and are solid.

The working temperature of an inkjet head is not limited to room temperature but the inkjet head is often used with heating, and it is necessary to obtain reliability for broad working temperature. An actuator that is a portion for head driving (ink jetting unit) is formed of ceramics material such as PZT and alumina, while a manifold member constituting an ink channel for supplying ink for this employs resin parts or metal parts from the viewpoint of suppressing increase of cost and easy processing. Therefore in assembling an inkjet head, there are some cases that parts having very different thermal expansion coefficients (linear expansion coefficients) must be jointed each other. At this time, a problem that distortion is generated between these members is caused by temperature change in working environment. Then there is a problem that a piezoelectric material of the actuator is affected by the stress owing such distortion, such that the characteristics are changed partially and variation in a driving voltage necessary for ink ejecting is found, which causes function failure owing to ejection speed abnormality.

Several ink-resistant adhesives require heating for being cured (for example, see JP-Tokukai-Hei-7-32597A). This increased temperature difference between a cure temperature of an adhesive in assembling an inkjet head and an environmental temperature in using the finished inkjet head, was a factor for compounding the problem of the above-described distortion generation, and narrows the range of selection of adhesives.

Further, even if there is no significant difference of a thermal expansion coefficient between an actuator and a manifold member, there are some of adhesives accompanied by volume shrinkage in being cured, and the volume shrinkage percentage increases in case of aiming at crosslink with a high density for improving ink-resistance. In case of a high stiffness of an adhesive and a large volume shrinkage percentage, there is a problem that distortion at the adhesive interface increases, consequently leading to function failure of the actuator as above, and additionally, interfacial peeling might be caused at worst.

As above, hitherto it has been difficult to satisfy both of securely performing the joint of an actuator containing a piezoelectric material and a manifold member and not damaging the characteristics of the piezoelectric material of the actuator.

SUMMARY OF THE INVENTION

An object of the present invention is to provide an inkjet head in which a joint between an actuator containing a piezoelectric material and a manifold member is performed securely and also the characteristics of the piezoelectric material of the actuator is not impaired, while the ink-resistance of the adhesive is ensured.

In accordance with the first aspect of the invention, an inkjet head comprises:

an electrostrictive actuator having an ink channel to eject ink; and a manifold member for supplying the ink to the ink channel, wherein the actuator and the manifold member are jointed with an adhesive containing adhesive material and balloon filler.

According to the inkjet head of the first aspect of the invention, a joint between an actuator containing a piezoelectric material and a manifold member is performed securely and also the characteristics of the piezoelectric material of the actuator is not impaired, while the ink-resistance of the adhesive is ensured.

Preferably, the actuator comprises a piezoelectric material.

Preferably, a ratio of the balloon filler to the adhesive material is 5:100 to 200:100 by volume.

Preferably, the balloon filler has a shell comprising a thermoplastic polymer.

Preferably, the balloon filler is filled with gas.

Preferably, the thermoplastic polymer is selected from a group consisting of polyvinylidene chloride, polyacrylonitrile and vinylidene chloride acrylonitrile copolymer.

Preferably, the balloon filler is swelled with heat treatment.

Preferably, a binder resin of the adhesive material has a glass transition point of 80° C. or more after the adhesive material being cured.

Preferably, the adhesive material is an epoxy adhesive.

Preferably, a coefficient difference of linear thermal expansion between the actuator and the manifold member is not less than 10 ppm/° C.

In accordance with the second aspect of the invention, a method for making an inkjet head, comprises:

preparing an electrostrictive actuator having an ink channel;

preparing a manifold member for supplying ink to the ink channel;

applying a coat of an adhesive to a joint surface between the actuator and the manifold member; and curing the adhesive, wherein the adhesive contains adhesive material and balloon filler.

According to the method for making an inkjet head of the second aspect of the invention, a joint between an actuator containing a piezoelectric material and a manifold member is performed securely and also the characteristics of the piezoelectric material of the actuator is not impaired, while the ink-resistance of the adhesive is ensured.

Preferably, the actuator comprises a piezoelectric material.

Preferably, a ratio of the balloon filler to the adhesive material is 5:100 to 200:100 by volume.

Preferably, the balloon filler has a shell comprising a thermoplastic polymer.

Preferably, the balloon filler is filled with gas.

Preferably, the thermoplastic polymer is selected from a group consisting of polyvinylidene chloride, polyacrylonitrile and vinylidene chloride acrylonitrile copolymer.

Preferably, the method further comprises swelling the balloon filler with heat treatment before the curing.

Preferably, a binder resin of the adhesive material has a glass transition point of 80° C. or more after the curing.

Preferably, the curing is performed at a temperature of 60° C. or more.

Preferably, the adhesive material is an epoxy adhesive.

Preferably, a coefficient difference of linear thermal expansion between the actuator and the manifold member is not less than ±10 ppm/° C.

An "electrostrictive actuator" is what converts electric energy into mechanical energy and give the mechanical energy to ink in an ink chamber to jet the ink through a nozzle. A "balloon filler" is a filler of a spherical shape having a cavity inside thereof.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENTS OF THE INVENTION

Hereinbelow, an embodiment of the present invention is described with reference to the drawings.

Figure 1:
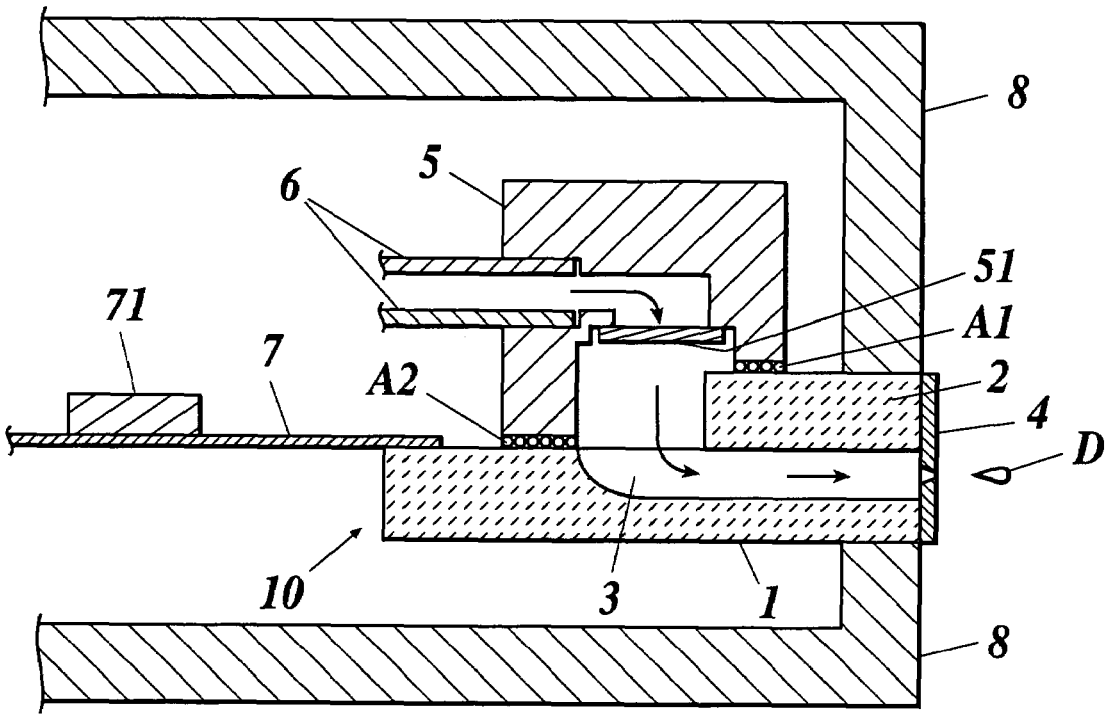
FIG. 1 is a sectional view showing an example of an inkjet head.

FIG. 1 is a sectional view showing an example of an inkjet head. In the drawings, the numerical reference 1 denotes a substrate comprising a piezoelectric material which is three walls in an ink chamber and has a lot of grooves arranged in parallel, 2 denotes a cap member which is bonded to the substrate 1 to be a wall sealing the upside of the ink chamber, and 3 denotes the ink chamber formed by respective grooves of the substrate 1 and the cap member 2. An actuator 10 is constituted of the substrate 1, the cap member 2 and the ink chamber 3 formed by them. The numerical reference 4 denotes a nozzle plate bonded to the front surface of the actuator 10 and comprises nozzle orifices for jetting ink drops corresponding to respective ink chambers 3 of the actuator 10. D denotes a jetted ink drop.

The numerical reference 5 denotes a manifold member constituting an ink channel for supplying ink for respective ink chambers 3 of the actuator 10, 6 denotes an ink tube bonded to the manifold member 5 for supplying ink from not shown ink storage, and 7 denotes an FPC (flexible print circuit) for energizing an electrode membrane formed on the side walls in the respective ink chambers 3 and on which a driving IC 71 is mounted. The numerical reference 8 denotes a cover for covering the entire inkjet head.

Arrows in the drawings shows a flow of ink. That is, ink passes from the not shown ink storage through the ink tube 6 to fill the ink channel in the manifold member 5. A filter 51, such as a wire netting, is provided in the manifold member 5 to remove foreigners in ink. Ink filtered with the filter 51 is poured from the manifold member 5 to the respective ink chambers 3 of the actuator 10. Meanwhile, when an image signal is transmitted from a control section of the inkjet printer body through the FPC 7, the driving IC 71 generates a voltage for shearing transformation of the side wall of a corresponding ink chamber 3 comprising the piezoelectric material, and energizes the electrode membrane of the side wall. As a result of this, the ink chamber 3 having the side wall sheared/transformed ejects an ink drop D from the ink orifice of the nozzle plate 4.

Here, the piezoelectric material constituting the substrate 1 of the actuator 10 is a material for converting electric energy into mechanical energy for ink ejecting, and concretely, a ceramics material, such as poled PZT (lead zirconate titanate), PLZT (PLZ with La solved) and alumina, is preferably used. Principally, mixed microcrystal of PbOx, ZrOx and TiOx in which a slight amount of metallic oxide as a softening agent or a hardening agent, e.g. oxide of Nb, Zn, Mg, Sn, Ni, La, Cr, or the like, is included, is preferable. Among others, PZT is preferable because of having a high packing density, a high piezoelectric constant and good processability.

A material having a thermal expansion coefficient (linear expansion coefficient) equal to the substrate 1 is used for a material of the cap member 2 jointed to the substrate 1 comprising such a piezoelectric material. The reason is to suppress occurrence of warping of the substrate 1. For this, in general, the same material as the substrate 1 is used without being poled.

As a material constituting the manifold member 5, a synthetic resin or metal material are generally used for suppressing increase of cost and in view of ease of processing. The synthetic resin includes acryl, polyether imide, modified polyphenylene ether, polycarbonate, polyamide, polyester and the like. Among others, polyether imide is preferable in that dimensional accuracy is good. The metal material includes aluminum and the like.

In the present embodiment, a jointing portion between the actuator 10 and the manifold member 5 with an adhesive is joints A1 and A2 shown in FIG. 1. The manifold member 5 is bonded to both of the cap member 2 and the ink chamber 3 of the actuator 10. Accordingly, here, it is adherence between different types of materials of a ceramics material and a synthetic resin, or a ceramics material and a metal material. Such a joint between different types of materials is accompanied by a problem of different thermal expansion coefficients in a lot of cases, and is preferable in the present embodiment because a significant effect is exerted as described below in case that the thermal expansion coefficients of the manifold member 5 and the actuator 10 including a piezoelectric material are different.

As an adhesive used for these joint, those including (1) adhesive material and (2) balloon filler and having the following characteristics are applicable.

(1) Adhesive Material

It is preferred to apply those which are stiff and have a high Tg to adhesive material in view of resistance to ink or solvent-resistance. Concretely, a binder resin in the adhesive material after curing preferably has a Tg not less than 80° C.

A kind of the adhesive material includes, for example, epoxy adhesive materials, phenol adhesive materials, polyurethane isocyanate adhesive materials, acrylic ester adhesive materials and the like. Among these, it is preferable to use epoxy adhesive materials in that epoxy adhesive materials are tough and have high adhesive strength and good solvent-resistance.

An epoxy adhesive material comprises a combination of (1. 1) an epoxy resin (base compound) and (1. 2) a curative.

(1. 1) Base Compound

The base compound includes bisphenol-A type epoxy resin, bisphenol-F type epoxy resin, phenol novolac type epoxy resin, cresol novolac type epoxy, epoxy resin with triazine skeleton, glycidyl amine type epoxy resin and the like.

(1. 2) Curative

The curative includes amine curatives, polyaminoamide curatives, anhydride curatives, dicyandiamide curatives, polymercaptan curatives, imidazole curatives and the like.

Details on these materials is minutely described in "Shin epokishi jushi handobukku I (New epoxy resin handbook I)" edited by Masaki Shimbo, The Nikkan Kogyo Shimbun, Ltd.

From the viewpoint of resistance to ink, in general, it is preferable to use a heat curing adhesive material which is cured by heating. Curing reaction of the adhesive material is slow, and accordingly heat curing process is required with consideration of working efficiency. As for adhesive materials whose curing reaction ordinarily proceeds at room temperature, such as an epoxy adhesive material using a polyaminoamide curative, there are some cases that higher ink-resistance is obtained by raising a curing temperature, and accordingly the adhesive materials may be used in the present embodiment.

Furthermore, various fillers, such as colloidal silica particles and alumina particles, may be mixed into adhesive material for giving thixotropy, giving thermal conductivity or the like.

(2) Balloon Filler

Balloon filler is an additive in the form of a balloon which includes gas.

Here, "the form of a balloon" indicates a thing which is in the form of a core/shell type of microcapsule that packs gas inside the shell. There are a swelling type and a not swelling type depending on the packed gas. In the present embodiment, with respect to the swelling type, a thing after swelling is called balloon filler. In general, those called a microballoon are preferably used for such balloon filler.

Such balloon filler is of several types, which are those having a shell comprising inorganic material such as glass and those having a shell comprising organic material. Further, organic material includes those comprising a thermosetting resin such as phenol resin and those comprising a thermoplastic resin such as polyacrylonitrile or polyvinylidene chloride. These all can stably add minute bubbles of several micron to several hundreds micron into adhesive material. While a method for adding babbles into adhesive material by using a blowing agent is also effective for the present purpose, a balloon filler like the above is used from the viewpoint of stability of babbles and reliability of sealing of adhesive material.

With respect to types of balloon filler, those having a shell for which thermoplastic polymer is used are preferable because they have good flexibility and accord with the present purpose much more. Among others, thermally expandable materials which comprise any one of polyvinylidene chloride, polyacrylonitrile and vinylidene chloride acrylonitrile copolymer and is made in the form of a balloon including gas by expansion by heating, are more preferable in terms of good stability in the adhesive material and less destruction of babbles.

As gas to be included, thermally expandable gas is used, and for example, hydrocarbon having a low boiling point (gas at room temperature), such as isobutane or isobutylene, is preferably used. These are capsulated in a liquid state inside a shell of thermoplastic polymer and the shell is softened by heating, so that liquid hydrocarbon is transformed into gas. Therefore, the pressure makes the filler into the form of a balloon including gas.

While a method shown below is taken as an example for a method for mixing such balloon filler into adhesive material, every method requires that the balloon filler exists in the form of a balloon with gas included before adhesive material is cured.

(1) Swelled balloon filler is mixed with adhesive material, and used directly. In this case, because the density of the balloon filler is low and workability is often difficult, workability is improved by using those which are made by sprinkling inorganic filler such as alumina or silica in balloon filler or adhesive material in advance. Additionally, there is benefit of good dispersibility in mixing into the adhesive material.

(2) In case of a two-part mixing type of adhesive material, workability is improved when swelled filler is preliminarily mixed into either or both of the adhesive materials in advance.

(3) In case of the use of balloon filler that is of a type of being swelled by heating, the balloon filler having not been swelled is mixed into adhesive material in advance, and the balloon filler is swelled through heat treatment for expansion.

(4) In case of a two-part mixing type of adhesive material, the workability is good, when balloon filler having not been swelled is mixed into base compound in advance, and the balloon filler is swelled through heat treatment for swelling and is made in the form of a balloon including gas, and subsequently, the adhesive material is mixed with a curative in the use of the adhesive material.

By jointing the actuator 10 including a piezoelectric material and the manifold member 5 by the use of an adhesive containing balloon filler like the above in this way, substantial elastic modulus of the adhesive can be reduced without damaging the characteristic of ink-resistance of the adhesive that is stiff and has a high Tg, and preferably in which binder resin of the adhesive material has a Tg not less than 80° C. That is, macroscopically, balloon filler gives minute spaces for resolving distortion into adhesive material, while, microscopically, balloon filler and adhesive material independently exist without blending. Thereby, it is possible to produce a situation in which chemical characteristics that the adhesive material essentially has are not degraded. Accordingly, it is possible to simultaneously solve a problem of the solvent-resistance of adhesive material, and a problem that the piezoelectric material constituting the actuator 10 ceases to function properly by stress suffered from distortions owing to temperature difference and shrinkage on curing of the adhesive material by reducing distortion caused by stiffness which is an issue such solvent-resistant adhesive material has.

Although cold setting adhesive materials are generally seemed to have a tendency of poor solvent-resistance, the solvent-resistance can be enhanced by raising a curing temperature and aiming at reaction with a high degree of crosslinking, and accordingly, nonaqueous inks such as oil inks or solvent inks can be used. In this case, there are some cases that the shrinkage percentage in curing becomes high and residual distortion of adhesive material becomes large to degrade the adhesion force, and particularly in the case of the shrinkage percentage of the adhesive material not less than 3%, some cases that adhesive peeling in heat cycle is caused and target adhesion performance cannot be obtained. However, these cases can be improved by mixing of balloon filler, adhesive materials and curing conditions which have not be usable ever is made usable and latitude in selection of adhesive material can be improved.

In general, as the forms of joints A1 and A2 between the manifold member 5 and the actuator 10 including a piezoelectric material, there are embodiments in which the forms are planar, in addition to embodiments in which the forms are linear. In particular, in case that the manifold member 5 and the actuator 10 including the piezoelectric material are jointed on multiple surfaces, distortions have larger effects on adhesives lying in the respective joints.

Figure 2:
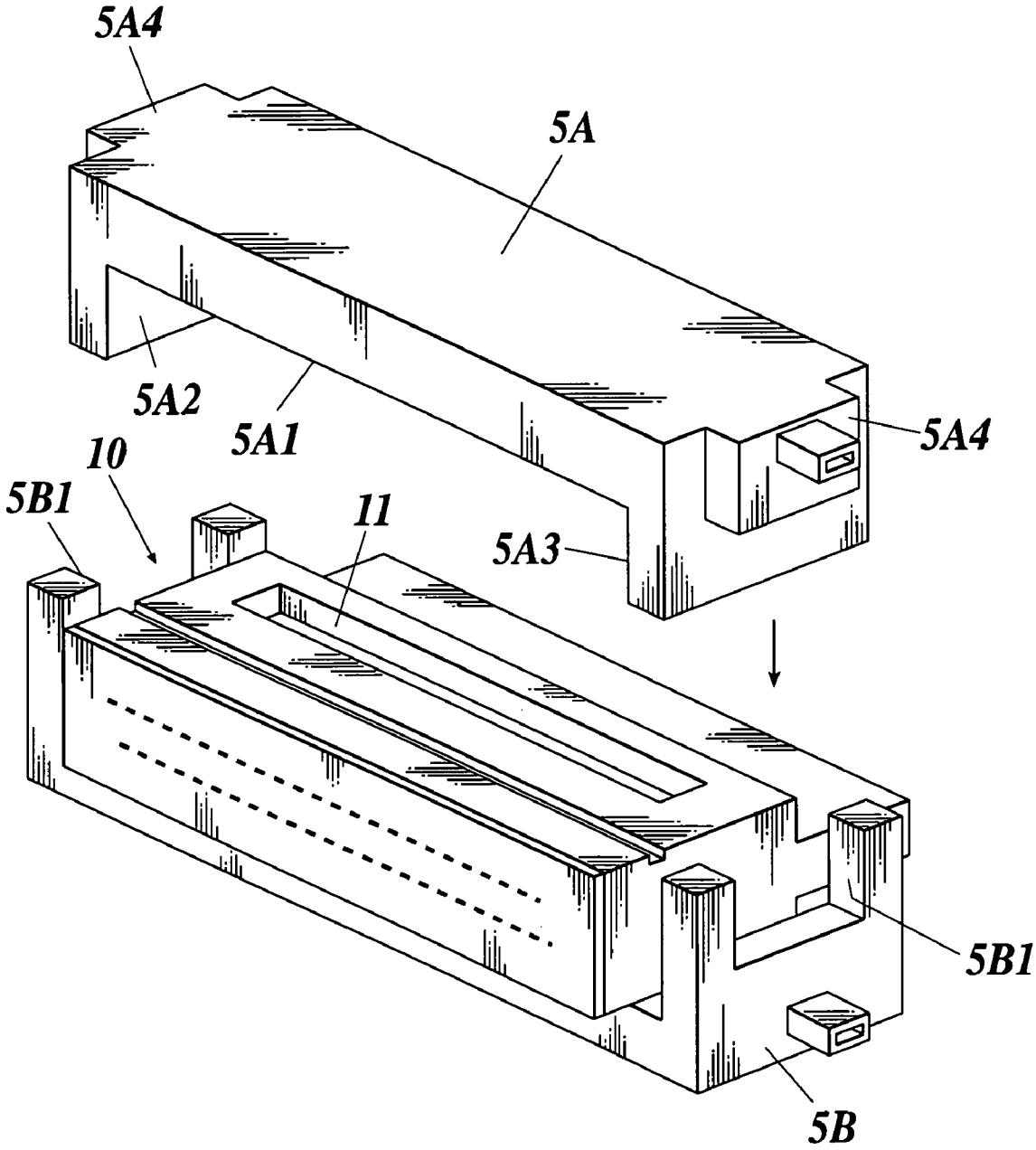
FIG. 2 is an exploded perspective view showing an embodiment in which an actuator and a manifold member are jointed such that the actuator is surrounded by the manifold member.

Among other cases of joints on multiple surfaces, as shown in FIG. 2, the problem of distortion is most critical in the cases the manifold member 5 and the actuator 10 including a piezoelectric material are jointed each other such that the actuator 10 is surrounded by the manifold member 5. That is, the actuator 10 constitutes an actuator that is of the multinozzle type in which two nozzle rows for jetting ink is arranged. A channel at each row is supplied with ink from ink supply openings 11 on upper and lower surface of the actuator 10, and accordingly the manifold members 5 are also attached to the upper and lower surface of the actuator 10, respectively. In this case, one manifold member 5A is jointed to the actuator 10 on three jointing surfaces 5A1, 5A2 and 5A3 and is jointed to the other manifold member 5B between a convex portion 5A4 and a concave portion 5B1. Therefore the actuator 10 is surrounded by the manifold member 5A and 5B on four sides so as to forming a surrounded jointing form.

The problem of distortion becomes large in such a surrounded jointing form because reduction of distortion of an adhesive in the surrounded jointing form requires volume change of the adhesive itself, while distortion is reduced by transform of the adhesive in linear or planar joints. In case of such jointing forms, applying an adhesive containing balloon filler also affects reduction of distortion along with volume change effectively.

From the viewpoint of obtaining such effects significantly, preferably, the blend ratio of balloon filler is 5 to 200% in terms of a volume ratio (in cases of a swelling type of balloon filler, a volume ratio after swelling of balloon filler) in relation to adhesive material 100% by volume. The ratio less than 5% is not preferable because the distortion reducing effect owing to balloon filler does not appear effectively. On the other hand, the ratio over 200% is not preferable because incomplete blend with adhesive material causes structurally weak portions to appear although a higher ratio of balloon filler makes the distortion reducing effect higher. More preferably, the ratio is 20 to 150%.

The maximum diameter of balloon filler (in cases of a swelling type of balloon filler, the maximum diameter after swelling of the balloon filler) is preferably 2 to 200 μm. The diameter less than 2 μm is not preferable because the distortion reducing effect owing to balloon filler does not appear effectively. On the other hand, the diameter over 200 μm is not preferable because incomplete blend with adhesive material causes structurally weak portions to appear although a higher ratio of balloon filler makes the distortion reducing effect higher. More preferably, the diameter is 5 to 100 μm.

It is preferred to use those which is coated with powder of calcium carbonate, titanium oxide or silicon dioxide in advance for balloon filler to be mixed with adhesive material. Although the balloon filler has a low specific gravity and might be affected by a wind of an air conditioner or the like to be dispersed away, there is an effect of suppressing these influences and improving workability in the blend process into adhesive material by using those coated in advance in this way.

Next, a method for manufacturing an inkjet head will be described.

Firstly, the manifold member 5 and the actuator 10 that has the substrate 1 and the cap member 2 jointed are prepared and the manifold member 5 is jointed to the actuator 10. Concretely, an it is sufficient that adhesive containing balloon filler is preliminarily applied to a jointing surface of the manifold member 5 and/or a jointing surface of the actuator 10 corresponding to the joints A1 and A2 shown in FIG. 1 by a coating method such as a dispensing process, screen coating process and roller coating process, and subsequently the manifold member 5 is jointed to a predetermined position of the actuator 10 and the adhesive is cured, or it is also sufficient that the manifold member 5 is located at a predetermined portion of the actuator 10 and an adhesive is injected to the joints A1 and A2 between both by using a hollow injection needle, followed by being cured. In a case of using a heat swelling type of balloon filler being not swelled, the balloon filler is swelled by heating before the adhesive is cured.

The thickness of the adhesive used for jointing the manifold member 5 and the actuator 10 including a piezoelectric material is preferably 2 to 150 μm in terms of the thickness after curing. The thickness less than 2 μm is not preferable because it becomes difficult to obtain a desired adhesive strength, and the thickness more than 150 μm is not preferable because failure rate owing to the adhesive pouring into the ink channel becomes significantly high. More preferably the thickness of the adhesive is 5 to 100 μm.

In the present embodiment, the effect owing to applying the above adhesive is significantly exerted in case of a difference of the thermal expansion coefficients (linear expansion coefficients) of the manifold member 5 and the actuator 10 including a piezoelectric material not less than 10 ppm/° C. because the problem of distortion acting on the adhesive used for jointing between both members becomes significant. If the difference of thermal expansion coefficients (linear expansion coefficients) is too large, the distortion reducing effect does not work well by the use of an adhesive mixed with balloon filler. Accordingly, the upper limit is preferably 120 ppm/° C.

In case of using a heat curing adhesive as an adhesive for jointing the manifold member 5 and the actuator 10 including a piezoelectric material, difference between the thermal expansion coefficients (linear expansion coefficients) of both members increases distortion acting on the adhesive for jointing between both members when the curing environment is not less than 60° C. because of a large temperature difference with situations in which the inkjet head after finishing assembly is located under use environment. Accordingly, also in this case, the effect owing to applying the above adhesive is significantly exerted. The curing temperature is preferably not more than 200° C. because there is a problem that polarization of the piezoelectric material included in the actuator 10 is eliminated and the piezoelectric material does not show piezoelectricity when the temperature is too high.

EXAMPLE

In the inkjet head structure shown in FIG. 1, jointing was performed in the joints A1 and A2 between the manifold member and actuator.

The actuator was configured by jointing non-poled PZT as a cap member to the upside of poled PZT having a lot of grooves provided in parallel, which constituted the ink chamber. The nozzle plate in which the ink orifice was formed was attached to the front face of the actuator. The nozzle number of the actuator was 128 nozzles, the nozzle pitch was 180 dpi (141 μm) and the linear expansion coefficient of the actuator was 3 ppm/° C.

Materials respectively shown in Table 1 (their linear expansion coefficients were described together) were used as the manifold member jointed to the actuator, and the manifold member is jointed with an adhesive, and inkjet heads shown as Examples 1 to 6 and Comparative Examples 1 to 4 were manufactured.

The specifications and curing conditions of adhesives used in manufacturing respective inkjet heads are shown in Table 1, respectively. The physical properties of each adhesive material and the characteristics of each balloon filler are shown in Tables 2 and 3, respectively.

TABLE 1

| | Manifold member | | | | | | |
|---|---|---|---|---|---|---|---|
| | Material | Linear expansion coefficient (ppm/° C.) | Adhesive material | Balloon filler | Blend ratio (weight) | Blend ratio (volume) | Curing condition |
| Example 1 | PEI | 53 | Epotek 353ND | F-46 | 10:0.2 | 100:80 | 60° C. 12 h |
| Example 2 | PEI | 53 | Epotek 353ND | F-80ED | 10:0.2 | 100:96 | 40° C. 48 h |
| Example 3 | PEI | 53 | Epotek 353ND | MFL-100CA | 10:1 | 100:92 | 60° C. 12 h |
| Example 4 | Alumina die cast | 21 | Epotek 353ND | MFL-80GCA | 10:1 | 100:60 | 60° C. 12 h |
| Example 5 | PEI | 53 | Epotek 353ND | F-30E | 10:0.2 | 100:96 | 60° C. 12 h |
| Example 6 | PEI | 53 | Cemedine EP171 | MFL-80GCA | 10:1 | 100:60 | 60° C. 6 h |
| Comparative example 1 | PEI | 53 | Epotek 353ND | None | Adhesive material 100% | Adhesive material 100% | 60° C. 12 h |
| Comparative example 2 | PEI | 53 | Epotek 310 | None | Adhesive material 100% | Adhesive material 100% | r.t. 12 h |
| Comparative example 3 | Alumina die cast | 21 | Cemedine EP171 | None | Adhesive material 100% | Adhesive material 100% | 60° C. 12 h |
| Comparative example 4 | PEI | 53 | Cemedine EP330 | None | Adhesive material 100% | Adhesive material 100% | r.t. 3 h |

TABLE 2

| Adhesive material | Type | Tg | Shore D hardness |
|---|---|---|---|
| Epotek 353ND | Epoxy two-part mixing | 12° C. | 87 |
| Epotek 310 | Epoxy two-part mixing | 20° C. or less | 22 |
| Cemedine EP171 | Epoxy two-part mixing | 83° C. | 87 |
| Cemedine EP330 | Epoxy two-part mixing | 45° C. | 80 |

TABLE 3

| Maker | Type | Size after swelling (μm) | Specific gravity | Shell material |
|---|---|---|---|---|
| Matsumoto Yushi-Seiyaku | F-46 | 40 to 70 | 0.03 | Polyacrylonitrile |
| Matsumoto Yushi-Seiyaku | F-80ED | 90 to 110 | 0.025 | Polyacrylonitrile |
| Matsumoto Yushi-Seiyaku | F-30E | 30 to 60 | 0.025 | vinylidene chloride acrylonitrile copolymer |
| Matsumoto Yushi-Seiyaku | MFL-100CA | 90 to 110 | 0.13 | Polyacrylonitrile coated with calcium carbonate powder |
| Matsumoto Yushi-Seiyaku | MFL-80GCA | 10 to 30 | 0.2 | Polyacrylonitrile coated with calcium carbonate powder |

In Tables 1 and 2, Epotek is an adhesive material produced by Epoxy Technology, and cemedine is an adhesive material produced by Cemedine Co., ltd.

Balloon fillers are swelled-type commercial product s except F-46.

In Example 1 in which F-46 was used as a balloon filler, F-46 and base compound of adhesive material were mixed in advance and swelled with heat treatment at 140° C., and subsequently they were mixed with a curative and used.

For each inkjet head manufactured in the foregoing way, tests shown below were performed and evaluated.

(Test for Solvent-Resistant Ink Characteristic)

Regarding a solvent used for solvent ink, cyclohexanone, ethyl lactate, xylene and ethylene glycol monobutyl ether are used as test liquids, respectively.

Adhesive pellets were dipped in the above test liquids at 60° C. for 1 week and rates of weight change were measured. The evaluation criterion is shown below.

O: Rates of weight change are not more than 8% for all test liquids.

X: A rate of weight change is more than 8% for any one of the above test liquids.

(Heat Cycle Test)

A cycle of 60° C. for 1 hour and −20° C. for 1 hour was repeated twenty times and the presence or absence of generation of seal leakage at the joints thereafter was checked. The evaluation criterion is shown below.

O: Seal leakage is not found.

X: Seal leakage is found.

(Test for Ejecting Speed Variation)

A driving voltage was applied so that the average ejecting speed of 128 nozzles was 8 m/s, and speed variation at the time was measured. The evaluation criterion is shown below.

O: A difference between the maximum ejecting speed and the minimum ejecting speed is not more than 2 m/s.

X: A difference between the maximum ejecting speed and the minimum ejecting speed is more than 2 m/s.

A comprehensive evaluation was made O with reference to those satisfying all in the evaluations of the above tests. The results are shown in Table 4.

TABLE 4

| | Solvent-resistant ink characteristic | Seal property after heat cycle test | Ejecting speed variation | Comprehension evaluation |
|---|---|---|---|---|
| Example 1 | ○ | ○ | ○ | ○ |
| Example 2 | ○ | ○ | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | ○ | ○ | ○ |
| Comparative example 1 | ○ | X | X | X |
| Comparative example 2 | X | ○ | ○ | X |
| Comparative example 3 | ○ | ○ | X | X |
| Comparative example 4 | X | ○ | ○ | X |

As found from Table 4, using an adhesive with balloon filler mixed in a joint between a manifold member and an actuator provided an inkjet head capable of solving a problem of function failure of a piezoelectric material caused by distortion generated by the difference between thermal expansion coefficients (linear expansion coefficients) of both members as well as being jointed securely and ejecting ink stably.

The entire disclosure of Japanese Patent Application No. Tokugan 2004-083278 filed on Mar. 22, 2004 including specification, claims, drawings and summary are incorporated herein by reference in its entirety.

What is claimed is:

1. An inkjet head comprising:

an electrostrictive actuator having an ink channel to eject ink; and a manifold member for supplying the ink to the ink channel, wherein the actuator and the manifold member are jointed with an adhesive containing adhesive material and balloon filler wherein a coefficient difference of linear thermal expansion between the actuator and the manifold member is not less than 10 ppm/°C.

2. An inkjet head of claim 1, the actuator comprising a piezoelectric material.

3. An inkjet head of claim 1, wherein a ratio of the balloon filler to the adhesive material is 5:100 to 200:100 by volume.

4. An inkjet head of claim 1, wherein the balloon filler has a shell comprising a thermoplastic polymer.

5. An inkjet head of claim 4, wherein the balloon filler is filled with gas.

6. An inkjet head of claim 4, wherein the thermoplastic polymer is selected from a group consisting of polyvinylidene chloride, polyacrylonitrile and vinylidene chloride acrylonitrile copolymer.

7. An inkjet head of claim 4, wherein the balloon filler is swelled with heat treatment.

8. An inkjet head of claim 1, wherein a binder resin of the adhesive material has a glass transition point of 80° C. or more after the adhesive material being cured.

9. An inkjet head of claim 1, wherein the adhesive material is an epoxy adhesive.

10. An inkjet head of claim 1, wherein the coefficient difference of linear thermal expansion between the actuator and the manifold member is not more than 120 ppm/°C.

11. An inkjet head of claim 1, wherein a maximum diameter of the balloon filler is 2 to 200 μm.

12. An inkjet head of claim 11, wherein the maximum diameter of the balloon filler is 5 to 100 μm.

* * * * *